US005092309A

United States Patent [19]

Beaton

[11] Patent Number: 5,092,309

[45] Date of Patent: Mar. 3, 1992

[54] LOCKING AND RELEASE MECHANISM FOR COMPOUND BOW

[76] Inventor: Joseph Beaton, 10016 Hillside Ter., Marcy, N.Y. 13403

[21] Appl. No.: 676,430

[22] Filed: Mar. 28, 1991

[51] Int. Cl.[5] ..... F41B 5/00

[52] U.S. Cl. ..... 124/35.2; 124/25.6; 124/86; 124/900

[58] Field of Search ..... 124/23.1, 24.1, 25.6, 124/35.2, 86, 88, 90, 900, 44.5

[56] References Cited

U.S. PATENT DOCUMENTS

| | | | |
|---|---|---|---|
| 4,246,883 | 1/1981 | Ash | 124/25.6 |
| 4,294,221 | 10/1981 | Bryant | 124/25.6 |
| 4,471,747 | 9/1984 | Nishioka | 124/23.1 |
| 4,886,039 | 12/1989 | Wagner | 124/25.6 |
| 5,000,154 | 3/1991 | Slayton | 124/23.1 |

*Primary Examiner*—Randolph A. Reese
*Assistant Examiner*—John Ricci
*Attorney, Agent, or Firm*—Katherine McGuire

[57] ABSTRACT

A locking and release mechanism for the bow string of a compound bow. The locking mechanisms are mounted adjacent to and operable with respective eccentric wheels on either end of the bow which includes a notch along the periphery of the wheel to engage a spring loaded lever of the respective locking lever when aligned therewith. The archer selectively locks the bow string in the drawn position by pulling on a string which runs colinearly and forwardly of the handle and attaches to one end of the lever whereby the lever is pulled downwardly against the bias of the spring to engage the notch in the wheel. To release the lock, the archer simply pulls the bow string a short distance past the locked position and releases which moves the wheels and disengages the levers therefrom thereby allowing the wheels to rotate and fire the arrow.

6 Claims, 2 Drawing Sheets

LOCKING AND RELEASE MECHANISM FOR COMPOUND BOW

BACKGROUND OF THE INVENTION

This invention relates to locking and release mechanisms and, more particularly, to such a mechanism incorporated into a compound bow structure which permits manual activation of the locking mechanism which acts to maintain the bow string in a drawn position, and selective release of the locking mechanism to permit shooting the arrow.

Hunting game with a compound bow has become a popular sport and hunters have discovered that the action of drawing the bow string upon sight of a game animal creates noise and motion which scares the game animals. The animals are highly sensitive to any motion or noise, thereby hindering the hunter's chance at firing an accurate shot. In response to this dilemma, special locking mechanisms have been invented since the advent of the compound bow which effectively lock the bow string in the almost fully drawn position until selectively released by the hunter. In this way, the hunter may lock his bow string in the set position while waiting for prey to come close, aim and release the lock by pulling the bow string past the set position to fire the arrow with a minimum of noise and motion, thereby improviding the opportunity of a more accurate aim than is available without such a locking mechanism.

The present inventor has discovered that of the locking mechanisms for compound bows of which he is aware, an arrangement of ratchet wheels and pawls are employed which automatically engage to lock the bow string at a selective one or, in some instances, any position along a predetermined length of bow string draw applied by the archer. Upon drawing the bow string past the predetermined length of draw, the locking mechanism automatically releases to fire the arrow. Examples of such locking mechanism may be seen in U.S. Pat. No. 4,294,221 issued to Bryant on Oct. 13, 1981, and No. 4,886,039 issued to Wagner on Dec. 12, 1989.

In both locking mechanisms of the aforementioned patents, the locking mechanism engages automatically upon drawing the bow string back to a drawn position. This type of locking arrangement may not always be desired by an archer since he may wish not to have the locking mechanism engage when, for instance, he is merely target practicing or the game is close by and a full, or nearly full draw on the bow string is not necessary.

It is therefore a main object of the present invention to provide a locking mechanism for a compound bow in which the locking action upon the bow string is not automatic upon drawing the bow string back, but instead manually actuable by the archer as desired.

It is another object of the present invention to provide a compound bow locking mechanism which is of simple construction and easy to install and use on a variety of present day compound bows.

It is a further object of the present invention to provide a manually engageable locking mechanism for the bow string of a compound bow which is releasable upon drawing the bow string only a short distance past its locked position.

It is still a further object of the present invention to provide a selectively actuable locking mechanism for a compound bow wherein the locking mechanism is engaged with very little noise or motion.

Other objects will in part be obvious and in part appear hereinafter.

SUMMARY OF THE INVENTION

In accordance with the foregoing objects, the invention comprises a locking mechanism for the bow string of a compound bow which is mounted at the distal ends of both the upper and lower limbs extending from the bow handle, adjacent and operable with the respective upper and lower eccentric wheels. A frame includes a base portion fixedly mounted to the upper part of the limb. A pair of spaced, parallel side plates linearly extend from the base toward the eccentric wheel, on opposite sides of the eccentric wheel. A rectangular shaped lever having parallel front and back bars and parallel side bars is pivotally mounted to the frame with the front bar of the lever spring biased in a direction away from the perimeter of the eccentric wheel.

One end of a lock activation string is anchored to the spring loaded lever and extends along and forward of the bow handle, the string being reachable with the fore-fingers of the hand which normally grasps the handle. By pulling on the lock activation string with the fore-fingers, the front bar of the levers on each end of the bow limbs are forced toward their respective eccentric wheels. Each eccentric wheel includes a notch on the outer perimeter thereof which, when rotated to a position adjacent the lever front bar, engages the front bar which is held in the wheel engaging position by pulling the lock activation string. Positioning of the front bar against the notch prevents the eccentric wheel from rotating in the direction which would fire the arrow.

Release of the bow string requires rotation of the wheel in the opposite direction, which occurs when the bow string is pulled further from the locked position. This disengages the notch on the wheel from the lever. Since the lever is spring biased in a direction away from the perimeter of the wheel, the lever automatically moves out of engagement with the notch and will not engage with it again until forced into position by the archer pulling on the lock activation string. In this way, the wheel is allowed to rotate freely through the force of tension in the bow string, thus firing the arrow.

DETAILED DESCRIPTION

Figure 1:
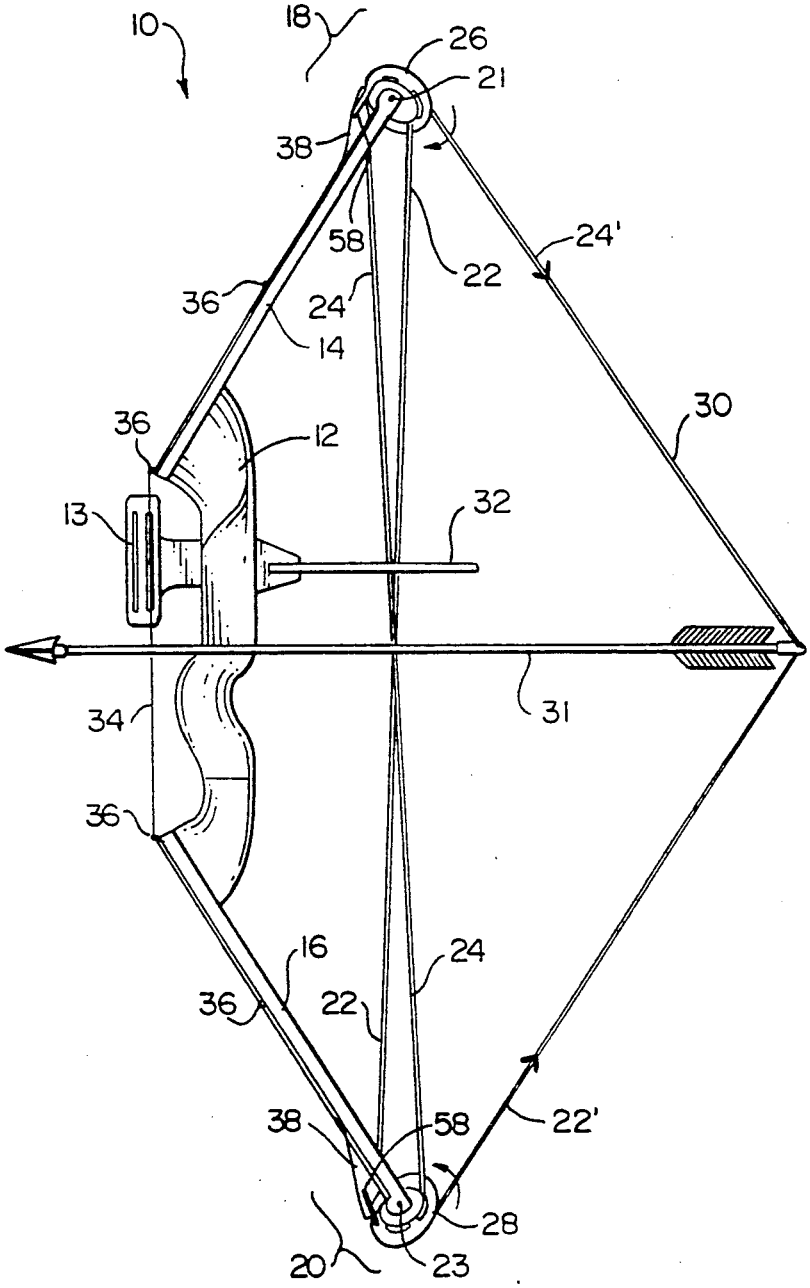
FIG. 1 is a side, elevational view of a compound bow and arrow incorporated with the locking mechanism at the terminal ends of each bow limb, the bow string being shown in the drawn and locked position.
Figure 2:
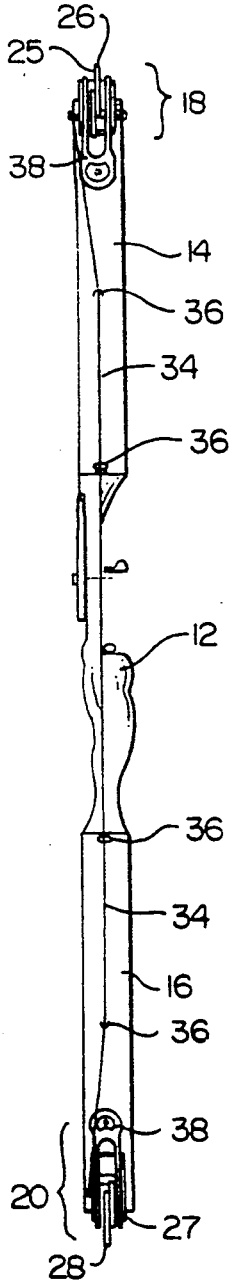
FIG. 2 is a front, elevational view of the compound bow of FIG. 1.

Referring now to the drawings, there is seen in FIG. 1 a compound bow 10 having a handle 12 with upper and lower, flexible limbs 14 and 16, respectively. Limbs 14 and 16 are seen to extend at an approximately 40° angle from the upper and lower ends of handle 12 and include bow string locking mechanisms 18 and 20 operably mounted upon the terminal ends of limbs 14 and 16, respectively, to be described more fully below. A pair of cables 22 and 24 extend between locking mechanisms 18 and 20, each cable being turned around opposite eccentric wheels 26 and 28 and being tied at their free ends 22' and 24' to opposite ends of bow string 30. More specifically, cable 22 is fixedly anchored at a first end thereof to the terminal end of limb 14 by pin 21, extends down and around eccentric wheel 28 at the distal end of opposite limb 16, and ties to bow string 30 at end 22'. Likewise, cable 24 is fixedly anchored at a first end thereof to the distal end of limb 16 by pin 23, extends up and around eccentric wheel 26 and ties to the opposite end of bow string 30 at end 24'. A cable clearance bar 32 known in the art extends perpendicularly rearward from lock activation string guidance bar 13 mounted to handle 12 and acts to keep cables 22 and 24 from entwining with each other.

Figure 4:
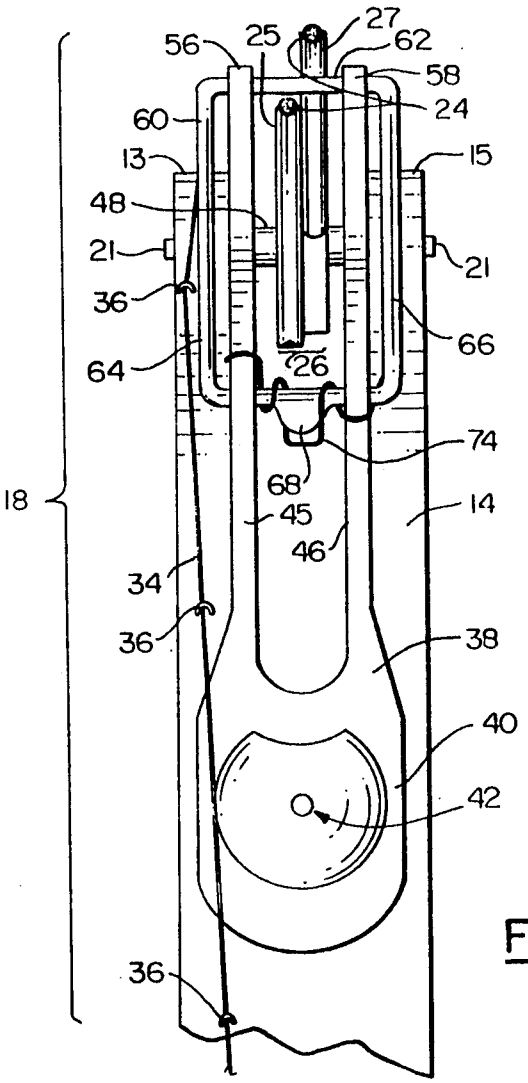
FIG. 4 is an enlarged, front elevational view of the locking mechanism as seen from the line 4—4 in FIG. 3.

An arrow 31 is nocked in bow string 30 and, as bow string 30 is drawn back by the archer, eccentric wheels 26 and 28 rotate in accordance with the directional arrows, cables 22 and 24 traveling around parallel tracks along the periphery of each wheel 26 and 28, tracks 25 and 27 of wheel 26 being shown in FIG. 4. As bow string 30 is drawn, limbs 14 and 16 are slightly flexed toward each other with respect to handle 12. The rotation of the eccentric wheels act as pulleys to decrease the force required to draw bow string 30 to its fully drawn position seen in FIG. 1. This is the standard operation which gives the compound bow its mechanical advantage over a standard bow.

The locking mechanism 18 and 20 are selectively actuated by the archer tensioning lock activation string 34 seen to extend from lock mechanism 18 to lock mechanism 20 along the front of handle 12, guided by eyelets 36. As such, the archer may draw the bow string 30 back to a nearly full draw in the usual manner, pull string 34, presumably with the index finger of the hand grasping handle 12, and lock the bow string 30 at the drawn position. The archer may thereafter release his grasp on bow string 30 and relax until a target comes into sight, the arrow 31 engaged in the drawn and locked bow string 30 ready for firing as seen in FIG. 1. When a target is in sight, the archer simply draws bow string 30 slightly past its locked position (e.g., less than an inch or two) and releases which disengages the locking mechanism and fires the arrow.

Figure 3:
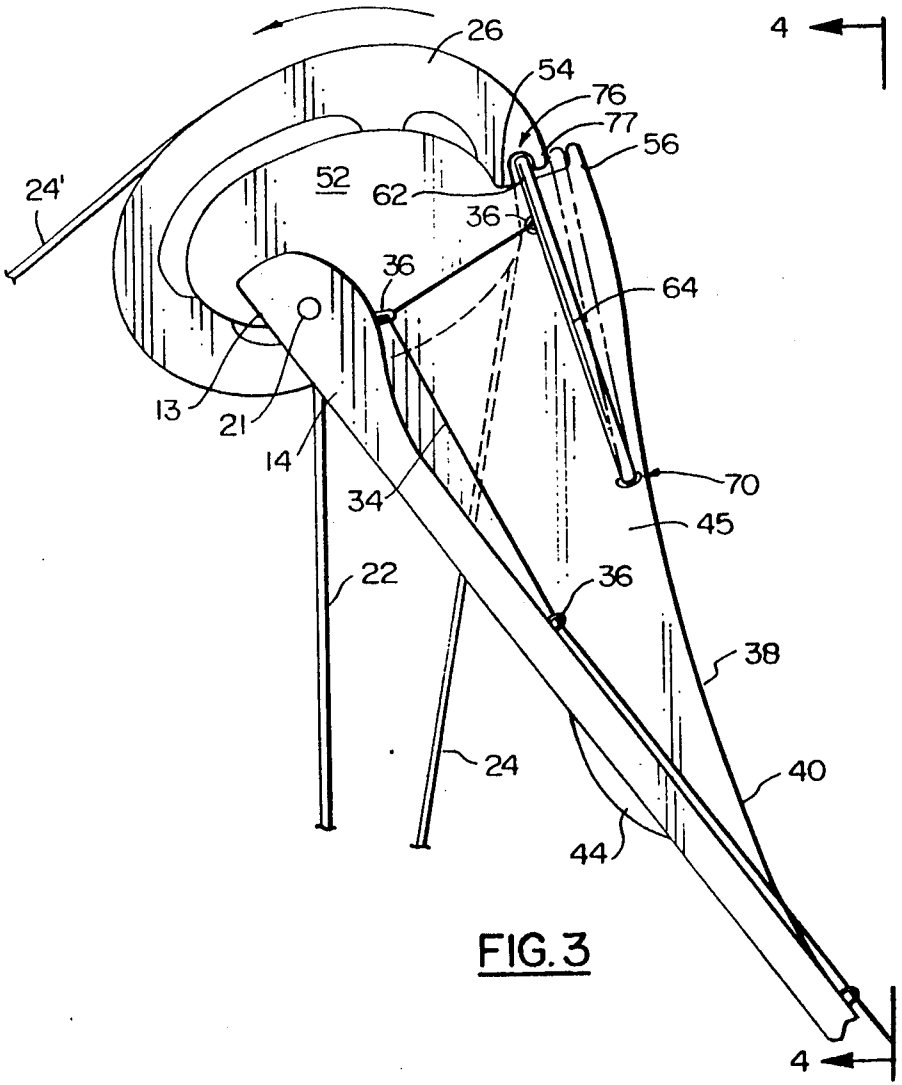
FIG. 3 is an enlarged, side elevational view of the locking mechanism mounted to the upper limb of the bow as seen in FIG. 1.

Referring now specifically to the mechanics of the locking mechanism which allows the bow string 30 to be selectively locked in the position seen in FIG. 1, attention is directed to FIGS. 3 and 4 which show the locking mechanism 18 operably mounted to the distal end of limb 14. It is pointed out that the components and operation of locking mechanisms 18 and 20 are identical, therefore, only locking mechanism 18 will be described in detail here.

Locking mechanism 18 is seen to include a rigid frame 38 which comprises a base plate 40 mounted upon the front surface of the upper, distal end of limb 14 with a bolt and washer 42 and 44, respectively, passing through a hole in plate 40 and an aligned hole formed in limb 14 (not shown). Frame 38 further includes parallel side plates 45 and 46 linearly extending in spaced relation from base plate 40 which are mounted to wheel shaft 48 on either side of wheel 26. In the fully assembled condition, side plates 45 and 46 are in abutting contact with the inside surfaces of the distal prongs 13 and 15 of limb 14 (FIG. 4). Pins 21 extend through aligned holes in prongs 13 and 15 to secure eccentric wheel 26, side plates 44 and 46, and prongs 13 and 15 together upon shaft 48.

It is seen most clearly in FIG. 3 that the side plates are configured to include a forward lobed portion 52 through which pin 21 extends at a lower portion thereof. A straight edge or indent 54 extends from an upper portion of the lobed portion 52 opposite its point of attachment to shaft 48, edge 54 terminating into a flange 56 (58 on side plate 46) which acts as a stop for the lever 60 when it is in its normally biased position, disengaged from wheel 26.

In particular, lever 60 is seen to be comprised of a front bar 62, opposite side bars 64 and 66, and a back bar 68. The back bar 68 extends through holes 70 and 72 in side plates 45 and 46, respectively (hole 72 not shown), whereby side bars 64 and 66 extend parallel to and adjacent the outer surfaces of side plates 45 and 46. A spring 74 is attached to back bar 68 and side plates 45 and 46 to bias lever 60 upward such that front bar 62 abutts flanges 56 and 58, this position seen in dotted outline in FIG. 3.

Wheel 26 has a notch 76 formed along the perimeter thereof for engaging front bar 62 of lever 60. When front bar 62 is engaged in notch 76 of wheel 26 as seen in FIG. 3, bow string 30 is locked in position as will be more fully understood below. As aforementioned, lock activation string 34 runs forwardly of and colinearly along handle 12 and limbs 14 and 16 through guide eyes 36. As seen in FIG. 3, the top end 78 of string 34 extends through eye 36 on distal prong 13 of limb 14 and is attached to an eye 36 mounted upon the underside of lever side bar 64 adjacent front bar 62.

Operation of the locking mechanisms 18 and 20 is as follows. The archer nocks an arrow 31 to bow string 30 in the usual manner and begins to draw it back. As bow string 30 is drawn back, the eccentric wheels located at either end of limbs 14 and 16 rotate in accordance with the directional arrows seen in FIG. 1. As the wheels rotate, notch 76 approaches front bar 62 of lever 60 which is in the normally biased position seen in dotted outline in FIG. 3, spaced from the perimeter of wheel 26. When bow string 30 is thus pulled to a nearly fully drawn position as seen in FIG. 1, and notch 76 has been rotated past front bar 62, the archer pulls on string 34 with the index finger of the hand grasping handle 12 which pulls front bar 62 of lever 60 downward against the bias. The archer proceeds to release tension upon bow string 30 thereby rotating wheel 26 in the opposite direction while simultaneously maintaining tension upon lock activation string 34. As the tip 77 of wheel 26 passes front bar 62, front bar 62 is pulled further downward and engages notch 76. The archer may thereafter completely release tension on bow string 30. The force of notch 76 bearing against front bar 62 prevents rotation of the wheels in the direction which would fire the arrow thereby "locking" bow string 30 in the nearly fully drawn position.

It may be realized from the foregoing that the archer may draw bow string 30 back and manually lock the bow string in the drawn position as desired by pulling lock activation string 34. When bow string 30 is in the drawn and locked position, the archer may completely release his grasp of bow string 30. Front bar 62 of lever 60 will not disengage from notch 76 due to the force being exerted against front bar 62 by notch 76. The archer may therefore relax while waiting for a target to come into sight. When a target does come into sight, the archer aims the bow and arrow in the usual manner and gently pulls back on bow string 30 a short distance past its locked position (normally an inch or less). As the bow string 30 is pulled further back, the wheels begin to rotate in the direction of the arrows in FIGS. 1 and 3. It may be seen in FIG. 3 that this rotation of wheel 26 would move tip 77 and notch 76 to the left, clear of front bar 62, thereby allowing lever 60 to move automatically and instantly upward due to the biasing effect of spring 74 to assume the position seen in dotted outline. With front bar 62 thus clear of the perimeter of wheel 26, the archer may release bow string 30 which causes rapid rotation of the wheels in the opposite direction and fires arrow 31.

It may be appreciated from the foregoing that there is provided a novel and unique locking mechanism for the bow string of a compound bow. The locking mechanisms 18 and 20 described herein may be easily incorporated into existing compound bow structures. The terms and expressions which have been used herein to describe the present invention are not used to limit the structure of the invention, equivalents of the features shown and described being within the scope of this invention as set forth in the claims which follow.

What is claimed is:

1. Apparatus mounted adjacent and operable with at least one rotatable, eccentric wheel of a compound bow structure for releasably an selectively locking the bow string in a drawn position, said apparatus comprising:

a) lever means positioned adjacent said one eccentric wheel and moveable between a first position wherein said lever means lies in spaced, adjacent relation to the periphery of said eccentric wheel, and a second, engaged position, wherein said lever means engages cooperative lever-engaging means on a portion of said eccentric wheel, thereby preventing rotation of said wheel in a predetermined direction which would rapidly release tension on said drawn bow string to fire an arrow nocked in said bow string;

b) biasing means urging said lever means toward said first position; and c) lock activation means positioned adjacent the handle portion of said compound bow and reachable with a finger of the hand grasping said handle during normal drawing of said bow sring, said lock activation means operably connected to said lever means wherein movement of said lock activation means by said finger acts to move said lever means from said first position to said second position upon alignment of said lever means and said lever engaging means, thereby preventing said eccentric wheel from rotating in said predetermined direction and locking said bow string in said drawn position, said biasing means automatically moving said lever means from said second position to said first position when said bow string is drawn a small distance beyond said locked, drawn position thereby releasing and allowing said eccentric wheel to rotate in said predetermined direction to fire said arrow.

2. The invention according to claim 1 wherein said lever means comprises a lever having a front bar, a back bar spaced and parallel to said front bar, and opposite side bars spaced and parallel to each other extending between and perpendicular to said front and back bars, said biasing means attached to said back bar.

3. The invention according to claim 2 wherein said lever engaging means comprises a notch formed on the peripheral edge of said eccentric wheel.

4. The invention according to claim 3 and further comprising a frame for supporting said lever, said frame including a base portion fixedly attached adjacent to the distal end of the limb extending from said handle portion of said compound bow, a pair of spaced, parallel side plates linearly extending from and in a plane perpendicular to said base plate, said plates positioned on opposite sides of said eccentric wheel, said lever back bar extending laterally through aligned holes in said side plates, and each of said side bars extend adjacent to the outer surfaces of said side plate, toward said eccentric wheel, said front bar extending laterally across a front edge of said side plates adjacent said eccentric wheel, said side plates including a forwardly projecting flange at the top edge thereof adjacent said lever front bar whereby said flanges act as a stop for said lever front bar when in said first position.

5. The invention according to claim 4 wherein said biasing means comprises a spring mounted to said side plates and said lever back bar.

6. The invention according to claim 1 wherein said lock activation means comprises a string connected to said lever means and extending adjacent said handle whereby tension created upon said string acts to pull said lever means toward said second position.

* * * * *